United States Patent [19]

Schuder

[11] 4,134,166

[45] Jan. 16, 1979

[54] MATTRESS CONSTRUCTION

[76] Inventor: Paul S. Schuder, Rte. 1, Box 1155, Woodland, Calif. 95695

[21] Appl. No.: 861,565

[22] Filed: Dec. 16, 1977

[51] Int. Cl.[2] ..... A47C 27/08

[52] U.S. Cl. ..... 5/345 R; 5/91; 5/355; 5/361 B; 297/284

[58] Field of Search ..... 297/1, DIG. 3, 284, 297/453; 5/349, 367, 368, 355, 361 B, 347, 345 R

[56] References Cited

U.S. PATENT DOCUMENTS

| | | | |
|---|---|---|---|
| 2,691,179 | 10/1954 | Kann | 5/368 |
| 2,748,399 | 6/1956 | Rockoff | 5/367 |
| 2,814,053 | 11/1957 | Sevcik | 5/368 |
| 3,209,380 | 10/1965 | Watsky | 5/367 |
| 3,959,835 | 6/1976 | Nos | 5/349 |

*Primary Examiner*—Casmir A. Nunberg

*Attorney, Agent, or Firm*—Lothrop & West

[57] ABSTRACT

A plurality of flexible tubes is disposed in a rectangular, elongated mattress body made of a foam such as urethane, rubber or the like and having top and bottom panels as well as side and end panels. A first set of tubes lies within the body in a plane parallel to the top panel and the first tubes extend in the longitudinal direction of the mattress body. Second and third sets of tubes are disposed in second and third planes parallel to the top panel, are on opposite sides of the first plane and extend in the transverse direction of the body. All the tubes merge with the side or end panels. The tubes are plugged to enclose air, each tube being provided with a valve for filling or releasing air to establish a desired pressure. If desired, the tubes in each set or all tubes can be interconnected by a manifold arrangement to facilitate air filling and releasing.

4 Claims, 3 Drawing Figures

MATTRESS CONSTRUCTION

BACKGROUND OF THE INVENTION

Air mattresses are well known in the art, typical examples being disclosed in U.S. Pat. Nos. 2,691,179 and 3,959,835.

So far as is known, few if any mattresses, whether they be found in the market place or in the patent literature, are constructed so as to provide firm yet comfortable support while preventing undue relative downward displacement of the mattress by the heavier of two persons of disparate weight.

A source of annoyance, as well as loss of sound sleep, is the temporary sag formed in the customary mattress by a relatively heavy person sleeping next to a relatively light person, the effect being to tend to cause the lighter person to roll toward the depression caused by the heavier person. The light person's effort to overcome the rolling tendency leads to restless sleep and fatigue.

The present application as well as my co-pending patent application, Ser. No. 836,717 now U.S. Pat. No. 4,106,142 dated Aug. 15, 1978 filed Sept. 26, 1977, disclose mattress constructions designed to alleviate the foregoing situation.

SUMMARY OF THE INVENTION

The present invention relates to an improved air mattress construction. Increased comfort and personal safety are provided by disposing a plurality of flexible, inflatable tubes in several parallel planes in tunnels previously cast in a rectangular mattress body made of foam, such as urethane, rubber or the like. The rigidity or local beam strength of the mattress is adjustable, first, by varying the air pressure in the tubes and, second, by using either smaller or larger tubes in the tube tunnels.

It is an object of this invention to make a mattress structure that is a unitary, integral or full sleeping platform, making unnecessary a box spring or other mattress foundation.

It is another object of the present invention to provide a mattress which has sufficient rigidity or beam strength for sufferers of back ailments but has a soft, upper surface for comfort.

It is a further object of the invention to provide a mattress construction which provides selectively firm yet comfortable support to two persons resting or sleeping on the mattress, even though one person is relatively heavy and the other is relatively light in weight.

It is yet a further object of the invention to provide a mattress construction which substantially if not entirely eliminates the undue sag, or downward displacement, or depression caused by one person's weight, and tending to roll an adjacent person of lighter weight toward the depression. The effort required to overcome this tendency leads to restless sleep and fatigue.

It is still another object of this invention to provide a mattress construction which is economical in that it requires no additional mattress, which is light in weight and so not a burden to the homemaker.

It is a further object of the invention to provide a mattress that is longlived in that it dispenses with metal springs which can become permanently deformed and cause discomfort.

It is another object of this invention to provide extra safety and comfort to the persons sleeping on this mattress by using a large, firm tube near the outside edge, eliminating the fear of falling.

Another object of this invention is to provide ease of manufacture from material all of which is readily available, and to provide that all the tubes and valves are easily removed for replacement or repair.

It is another object of the present invention to provide a generally improved mattress structure, of different softness and supportive character in different areas or zones, fully reversible, safe, longlived, energy conservant and comfortable.

Other objects, together with the foregoing, are attained in the embodiment described in the following description and illustrated in the accompanying drawings.

DESCRIPTION OF PREFERRED EMBODIMENT

Figure 1:
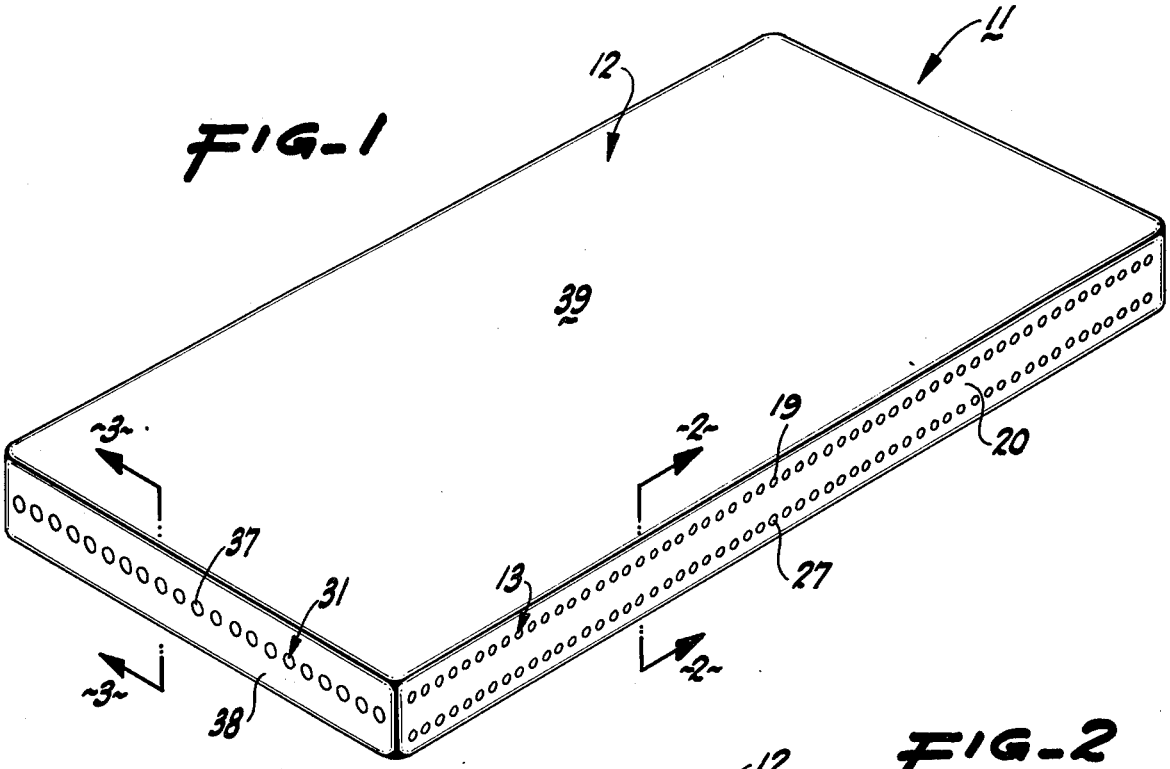
FIG. 1 is a diagrammatic, perspective view of a mattress embodying the present invention.
Figure 2:
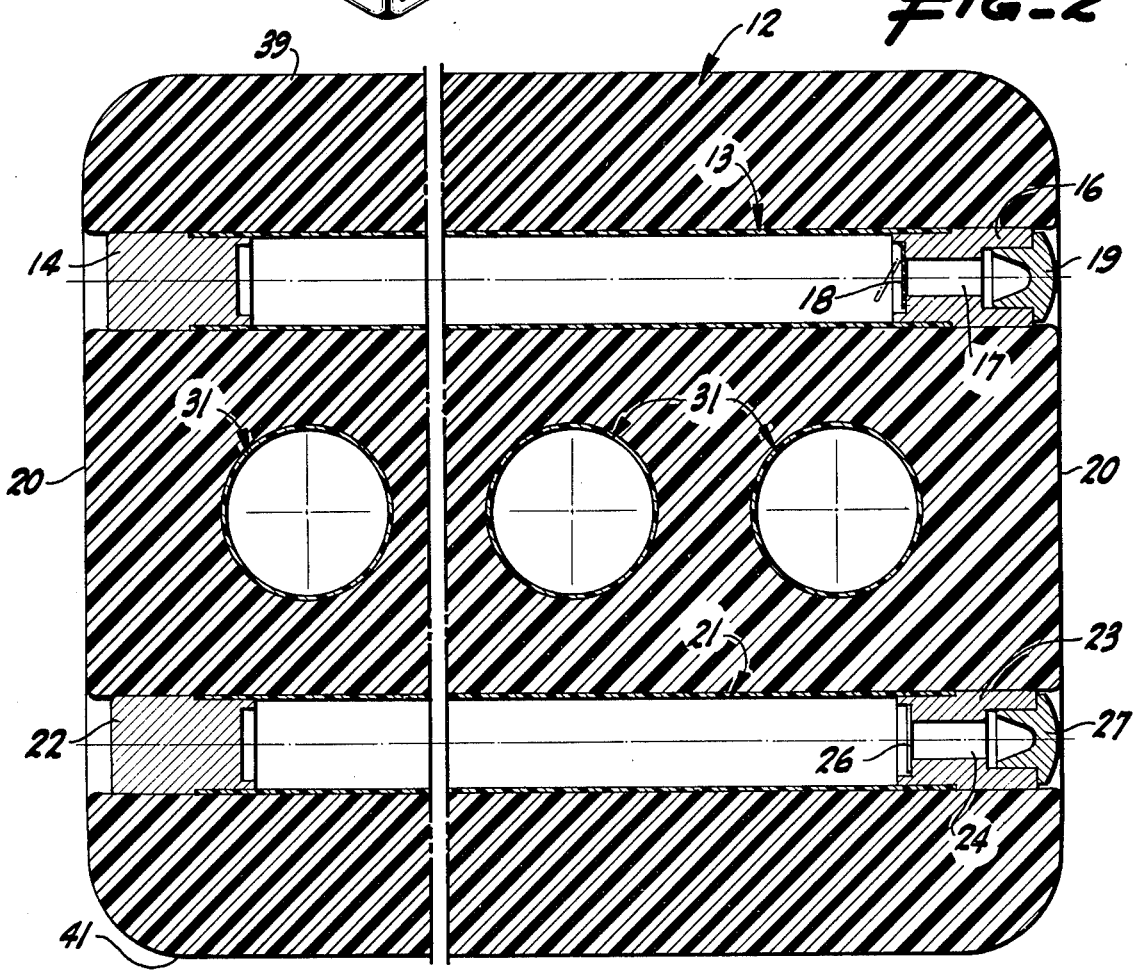
FIG. 2 is a sectional view, to an enlarged scale, and with a portion broken away, the plane of the section being indicated by the line 2 — 2 of FIG. 1; and, FIG. 3 is a sectional view, to an enlarged scale, with a portion broken away, the plane of the section being indicated by the line 3 — 3 of FIG. 1.
Figure 3:
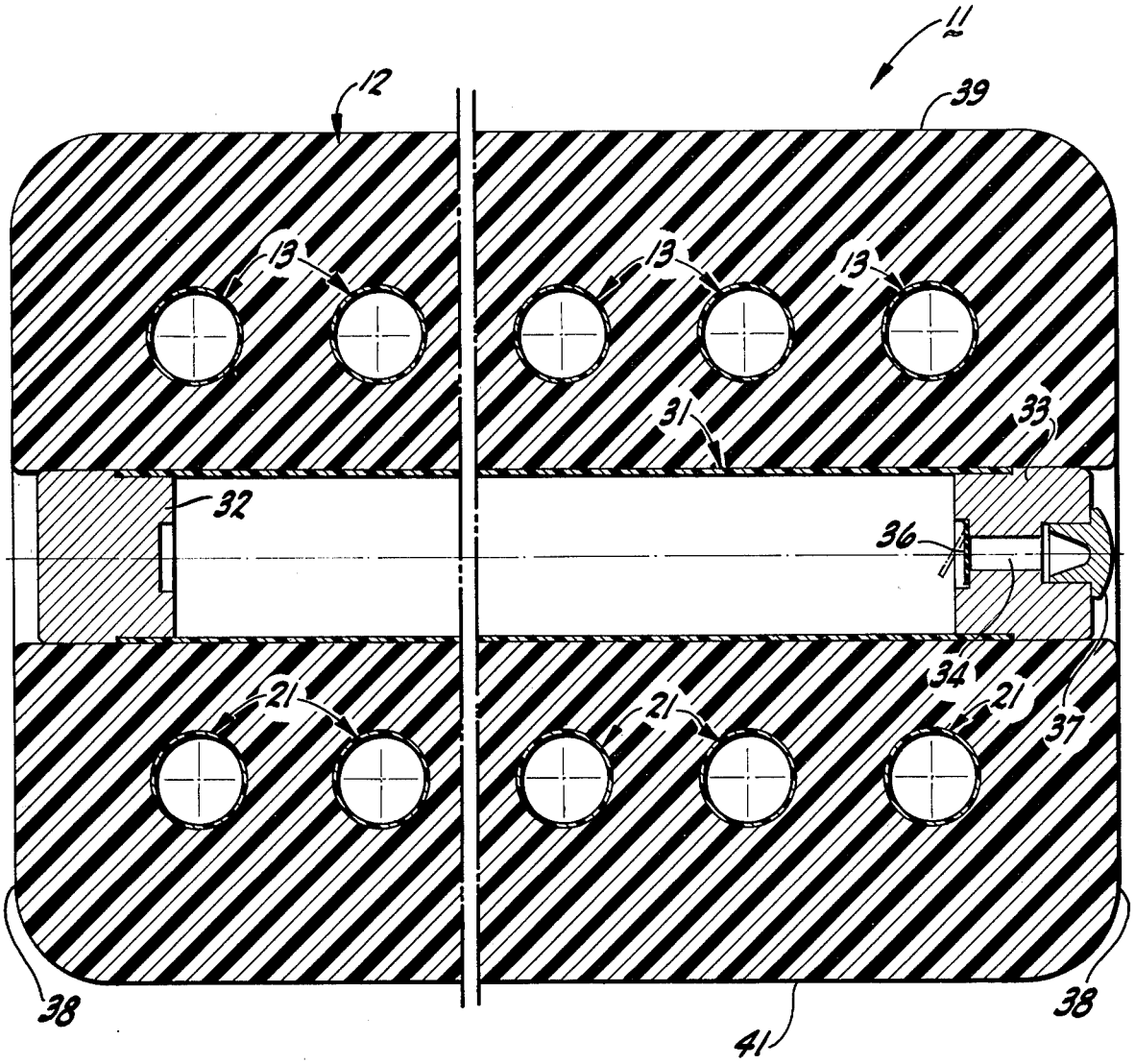

While the mattress construction of the invention is susceptible of numerous physical embodiments, depending upon the environment and the requirements of use, at least one of the herein shown and described embodiments has been made, tested and used, and has performed in a successful manner.

A mattress, generally designated 11, embodying the present invention comprises a rectangular body 12 of any of the customary and convenient sizes and is made of a resilient material, such as urethane or foam rubber. The mattress is normally placed flat, in a horizontal attitude, for use. In customary fashion the mattress is elongated in the direction assumed by the user's body.

The rectangular body 12 is customarily made by casting of the foam. As part of the process, numerous tunnels are formed in the foam in a predetermined pattern. Disposed in and through selected ones of the cast or precast tunnels in the mattress body 12 is a plurality of upper flexible tubes 13. The tubes 13 are made of a plastic or rubber material preferably less resilient than the resilient foam material of the body 12. The tubes 13 are parallel to each other and extend in an upper, horizontal plane parallel to the upper panel of the body in the transverse direction of the mattress body 12. The tubes 13 stop short of the ends of the tunnels merging with at least one of the side panels and are closely fitted with special plugs 14 and 16 in a leakproof engagement. The plugs 14 and 16 are closely but removably received in the tunnels but do not project from the sides.

While the plugs 14 are substantially solid and plain, each of the plugs or closure members 16 has a passageway 17 formed through it for the passage of air to fill the associated tube 13 with air. A flapper valve 18 is provided at the interior end of each of the passageways 17 to prevent air from escaping from the respective tube 13 but air can be released by displacing the flapper valve by using a rod or other convenient displacement tool. A friction held cap 19 located at the exterior end of the passageway 17 normally protects the passageway but may be removed for filling of the tube 13. Each tube 13 can thus be individually pressurized to the desired extent to produce the individual or local pressure adjacent the individual tubes deemed to afford the maximum comfort to the particular user.

Alternatively, all the tubes 13 can be interconnected so that air need only be introduced or withdrawn at one location. A manifold arrangement (not shown) such as a conduit (not shown) extending along one or both side panels 20 of the mattress body with the conduit connected to all tubes 13 affords a simple filling and draining arrangement.

In a similar manner, a plurality of tubes 21 is provided in a horizontal plane spaced below the plane of the tubes 13. Closure members or plugs 22 and 23 like the plugs 14 and 16 are installed in the ends of each tube 21. A flapper valve 26 is provided at the interior end of each closure member 23 and a closure cap 27 is detachably provided at the exterior end of a passageway 24 like the passageway 17. The lower tier of tubes 21 or selected ones of them can be interconnected, as by a manifold (not shown) for simultaneous pressurizing or air release.

A plurality of parallel tubes 31 is disposed in an intermediate horizontal plane parallel to the top panel 39 and located between the upper and lower planes of the transverse tubes 13 and 21. The tubes 31 are similar to the tubes 13 and 21 except that the tubes 31 extend in the longitudinal, rather than the transverse direction of the mattress body 12 and are preferably somewhat larger in diameter to afford greater beam strength. Closure members or plugs 32 and 33 are installed within the ends of the longitudinal tubes 31. Each closure member 33 is provided with a longitudinal passageway 34, a flapper valve 36 and a cap 37. As before, some or all of the tubes 31 can be interconnected to facilitate pressurizing selected ones or all of the tubes with air or to release air therefrom.

In one arrangement, each of the tubes 13, 21 and 33 is supplied with air through the respective passageways 17, 24 and 34 by means of an air pump or the like and to an extent depending on the desired rigidity of some or all of the mattress 11 in the area of each tube. The greater the air pressure in a tube the greater the beam strength or rigidity of the mattress 11 in the vicinity of that tube. The portions of the mattress body 12 above the tubes 13 afford a pressure distribution and a surface softness which is necessary or is selected for comfortable sleeping. The tubes, although increasing the rigidity of the mattress 11 in proportion to their inflation pressure, yield or flex to a selected extent to allow the mattress 11 to conform to the body of the sleeper. The portion of the mattress body 12 below the lower tubes 21 assists in distributing the mattress load and allows flexure of the tubes.

In summary, the present mattress provides resistance to damage, provides selective or increased rigidity desired for sufferers of back ailments and means for adjusting the rigidity to the desired extent and also affords desirable degrees of comfort to persons of different weight.

A person of very light weight appreciably deflects only the body of resilient foam material between the top surface 39 of the mattress body and the top layer of transverse tubes 13. A person of greater weight also deflects to some extent the subjacent transverse tubes 13 but not the longitudinal tubes 31 to any significant degree.

Should the person be quite heavy, the longitudinal tubes 31 underlying the person deflect. However, since the tubes 31 are longitudinally oriented, only the tubes 31 immediately subjacent the person or those tubes close to those subjacent tubes would deflect. Tubes 31 not immediately below the person do not substantially deflect. The downward displacement of the longitudinal tubes is largely limited to the subjacent tubes and does not carry over appreciably to another person on the mattress. The downward displacement of the mattress caused by a heavy person is limited or restricted and so does not have a tendency to cause the other person, even one considerably lighter in weight, to roll toward the depression caused by the heavier person. The displacement can be regulated by disposing one or two slightly larger tubes 31 near the longitudinal center of and within the mattress. Additionally and alternatively the air pressure therein can be increased.

The mattress body 12 is symmetrical, considered vertically, about a median horizontal plane through the intermediate layer or tier of tubes 31. The intermediate tubes 31, being somewhat larger in diameter than the tubes in the upper or lower layers ordinarily being filled with air under substantial pressure, provide a beam strength effective to accommodate even a very heavy person. Not only the upper tubes 13 but also the lower tubes 21 and the intervening resilient foam material lend supportive effort in the case of a large, heavy person. The symmetrical arrangement also permits the use of the mattress either with the surface 39 uppermost or with the bottom panel surface 41 on top.

The disclosure provides a versatile, light and comfortable mattress construction conducive to restful slumber by persons of all weights and body proportions.

What is claimed is:

1. A mattress comprising:

a. an elongated body of resilient foam material having top and bottom panels and side panels and end panels;

b. a plurality of first parallel, flexible tubes disposed in said body and extending in a first plane parallel to said top panel and disposed in the longitudinal direction of said body;

c. a plurality of second parallel, flexible tubes disposed in said body and extending in a second plane parallel to said top panel and disposed in the transverse direction of said body;

d. a plurality of third parallel, flexible tubes disposed in said body and extending in a third plane parallel to said top panel and disposed in the transverse direction of said body, said first plane being located between said second plane and said third plane, said first tubes, said second tubes and said third tubes being arranged in vertical symmetry between said top panel and said bottom panel and having a different beam strength than said body, said first tubes being larger in diameter than said second and said third tubes; and, e. means in at least some of said tubes for receiving and holding air therein, said receiving and holding means including air passages and valves in said air passages.

2. A mattress as in claim 1 in which the interiors of at least some of said tubes are interconnected with a common source of air under pressure.

3. A mattress as in claim 1 in which said first tubes merge with at least one of said end panels.

4. A mattress as in claim 1 in which said second and third tubes merge with at least one of said side panels.

* * * * *